United States Patent [19]

Barthel

[11] 4,417,900

[45] Nov. 29, 1983

[54] HIGH TEMPERATURE SOLID FIRE STARTER

[76] Inventor: Horst K. F. Barthel, Mozartstr. 3, D-7334 Süssen, Fed. Rep. of Germany

[21] Appl. No.: 349,942

[22] Filed: Feb. 18, 1982

[51] Int. Cl.[3] ..... C10L 11/00; C10L 11/04

[52] U.S. Cl. ..... 44/34; 44/41; 149/43

[58] Field of Search ..... 44/1 R, 6, 41, 34, 38; 149/43

[56] References Cited

U.S. PATENT DOCUMENTS

| | | | |
|---|---|---|---|
| 1,817,458 | 8/1931 | Munchow | 44/41 |
| 1,839,987 | 1/1932 | Michels . | |
| 2,316,358 | 4/1943 | Nickle | 149/43 |
| 2,432,347 | 12/1947 | Speaker | 44/1 R |
| 2,854,321 | 9/1958 | Stanton | 44/39 |
| 3,089,760 | 5/1963 | Jaffe | 44/41 |
| 3,390,029 | 6/1968 | Preckel | 149/43 X |
| 3,645,810 | 2/1972 | Genden | 149/43 |
| 3,733,223 | 5/1973 | Lohkamp | 149/43 X |

FOREIGN PATENT DOCUMENTS

| | | | |
|---|---|---|---|
| 2128903 | 10/1972 | France | 44/1 R |
| 44-21427 | 12/1969 | Japan | 44/1 R |
| 56-28293 | 3/1981 | Japan | 44/1 R |

*Primary Examiner*—Carl F. Dees

*Attorney, Agent, or Firm*—Fulbright & Jaworski

[57] ABSTRACT

A solid fire starter which will provide a high temperature consisting of a mixture of hexamethylenetetramine, magnesium powder, an oxygen producing chemical, and a binder. The preferred proportion of magnesium to hexamethylenetetramine is about 2 to 3. The preferred oxygen-producing chemicals include tartaric acid and sodium nitrate. The preferred composition comprises 80 parts of magnesium powder, 120 parts of hexamethylenetetramine, 50 parts tartaric acid, 100 parts sodium nitrate, and 45 parts of wax.

5 Claims, No Drawings

HIGH TEMPERATURE SOLID FIRE STARTER

BACKGROUND OF THE INVENTION

Various types of fire starters have been used to initiate combustion of other fuels such as coal, charcoal and wood. For example, various petroleum liquids have been utilized and various types of dry inflammable material utilizing hexamethylenetetramine have been used as disclosed in U.S. Pat. Nos. 1,839,987; 2,854,321; and 3,089,760. However, the liquid starters are dangerous as being explosive in nature and subject to fire flashbacks, and even the solid types are subject to sublimation or evaporation over a period of time and do not provide a sufficiently hot flame for quickly and easily igniting damp fuels. And while solid magnesium has been suggested as a fire starter in U.S. Pat. Nos. 4,188,192 and 3,402,029, it has not secured any widespread acceptance due to difficulty of its ignition.

The present invention is directed to a stable solid material which may be easily ignited and which will produce slow burning matter with a high temperature and will further insure the high temperature combustion by producing additional combustive oxygen to quickly ignite damp inflammable matter such as wood, charcoal or coal.

SUMMARY

The present invention is directed to a solid fire starter for starting fires that provides a high temperature flame, is easily ignitable, and includes an oxygen-producing ingredient and a suitable binder. Hexamethylenetetramine is included to provide an easily ignitable starter and is mixed with magnesium powder to produce a higher burning temperature. The oxygen-producing ingredient provides additional oxygen for increasing the temperature, and any suitable binder is provided for conveniently molding a solid fire starter.

An object of the present invention is the provision of such a solid fire starter wherein the oxygen-producing chemical ingredient includes tartaric acid and sodium nitrate.

A further object of the present invention is the provision of such a solid fire starter wherein the proportion of magnesium to hexamethylenetetramine is 2 to 3.

Still a further object of the present invention is a provision of a preferred embodiment of a high temperature solid fire starter which comprises by weight 80 parts of magnesium powder, 120 parts of hexamethylenetetramine, 50 parts tartaric acid, 100 parts sodium nitrate, and 45 parts of a suitable binding wax such as benowax or paraffin.

Other and further objects, features and advantages will be apparent from the following description of a present and preferred embodiment of the invention, given for the purpose of disclosure.

DESCRIPTION OF THE PREFERRED EMBODIMENT

A solid fire starter is preferable for starting open fires as compared with liquid type starters which are dangerous as being somewhat explosive and subject to dangerous flameups as well as burning off quickly. The present invention is directed to providing a compressed solid stable material of any convenient size, such as 50 grams, although any desired size may be used. The present starter includes hexamethylenetetramine which is easily ignitable but has a disadvantage in that the flame temperature will only reach 560° C. which may not be sufficient to start a fire under adverse conditions such as starting damp wood, briquettes, charcoal and coal.

In order to create a hotter burning fire, magnesium powder or otherwise comminuted magnesium is combined with the hexamethylenetetramine which produces a much higher temperature. The mixture is blended together and bonded in suitable shapes and sizes by any suitable wax or paraffin such as benowax which will not only support combustion and provide a binder, but also will provide waterproofing and will resist sublimination or evaporation of the hexamethylenetetramine.

In order to promote a higher temperature burning flame, it is desirable to provide additional oxygen which will also speed up the ignition of the inflammable matter. Tartaric acid, sodium nitrate or various peroxides may be provided as suitable oxygen-building chemical ingredients.

The resulting mixture provides a high flame temperature of about 1,000° C. and will maintain this temperature at a slow burning rate to provide a fire starter that will burn for approximately eight minutes when using about 50 grams. The combination of the high temperature and slow burning rate provide an ideal fuel starter which will start other fuels under adverse conditions.

The embodiment of the present invention includes the following ingredients in the following ranges and preferred proportions:

| Range | Preferred |
|---|---|
| 10–120 | 80 parts of magnesium powder |
| 40–200 | 120 parts hexamethylene tetramine |
| 50–150 | 50 parts tartaric acid |
| 100–350 | 100 parts sodium nitrate |
| 40–165 | 45 parts benowax |

It will be recognized by those skilled in the art, however, that the proportions indicated above may be varied and that other oxygen-building and binding materials may be used.

The present invention, therefore, is well adapted to carry out the objects and obtain the ends and advantages mentioned as well as others inherent therein. While a presently preferred embodiment of the invention is given for the purpose of disclosure, numerous changes in the compositions and proportions thereof will readily suggest themselves to those skilled in the art and which are encompassed within the spirit of the invention and the scope of the appended claims.

What is claimed is:

1. A high temperature solid fire starter comprising hexamethylenetetramine, magnesium powder, and oxygen producing chemical selected from the group consisting of tartaric acid, sodium nitrate and peroxide, and a wax binder.

2. The composition of claim 1 wherein the proportion of magnesium to hexamethylenetetramine is approximately 2 to 3.

3. The composition of claim 1 wherein the proportions are about 80 parts of magnesium powder, 120 parts of hexamethylenetetramine, 150 parts of the oxygen producing chemical, and 45 parts of the binder.

4. A high temperature solid fire starter comprising,
80 parts of magnesium powder,
120 parts of hexamethylenetetramine,
50 parts tartaric acid, 100 parts sodium nitrate, and 45 parts of wax.

5. A high temperature solid fire starter comprising,

10–120 parts of magnesium powder,

40–200 parts of mexamethylenetetramine,

50–150 parts tartaric acid,

100–350 parts sodium nitrate, and

40–165 parts benowax.

* * * * *